US008014710B2

(12) United States Patent
Hasegawa

(10) Patent No.: US 8,014,710 B2
(45) Date of Patent: Sep. 6, 2011

(54) CONVEYOR-BELT APPARATUS AND IMAGE HEATING APPARATUS

(75) Inventor: Kazuhiro Hasegawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 378 days.

(21) Appl. No.: 12/367,847

(22) Filed: Feb. 9, 2009

(65) Prior Publication Data

US 2009/0208260 A1 Aug. 20, 2009

(30) Foreign Application Priority Data

Feb. 18, 2008 (JP) ..... 2008-036501

(51) Int. Cl.
*G03G 15/20* (2006.01)

(52) U.S. Cl. ..... 399/325; 399/329

(58) Field of Classification Search ..... 399/325, 399/329

See application file for complete search history.

(56) References Cited

U.S. PATENT DOCUMENTS

| | | | | |
|---|---|---|---|---|
| 5,512,993 | A | 4/1996 | Endo et al. | 355/285 |
| 5,853,832 | A | 12/1998 | Ishikawa | 428/36.2 |
| 6,937,828 | B2 | 8/2005 | Hasegawa et al. | 399/69 |
| 7,024,144 | B2 | 4/2006 | Akita et al. | 399/328 |
| 7,050,748 | B2 | 5/2006 | Akita et al. | 399/328 |
| 7,392,006 | B2 * | 6/2008 | Kameda et al. | 399/329 |
| 2006/0245800 | A1 * | 11/2006 | Fujino | 399/329 |
| 2007/0059060 | A1 | 3/2007 | Kameda et al. | 399/329 |

FOREIGN PATENT DOCUMENTS

| | | |
|---|---|---|
| JP | 7-92843 | 4/1995 |
| JP | 9-185282 | 7/1997 |
| JP | 10-213984 | 8/1998 |
| JP | 2001-75387 | 3/2001 |
| JP | 2007-79036 | 3/2007 |

* cited by examiner

*Primary Examiner* — Matthew Luu
*Assistant Examiner* — Frederick Wenderoth
(74) *Attorney, Agent, or Firm* — Fitzpatrick, Cella, Harper & Scinto

(57) ABSTRACT

An image heating apparatus including: an endless belt; a heating rotary member for heating a toner image on a sheet at a heating nip between the belt and the rotary member; a pressure member provided slidably on an inner surface of the belt at the heating nip, for bringing the belt into pressure contact with the rotary member; and a lubricant applying roller including a lubricant retaining layer for retaining a lubricant and a lubricant applying amount controlling layer for controlling an applying amount of the lubricant, the lubricant applying roller abutting against the inner surface of the belt to apply the lubricant onto the inner surface of the belt while rotating, in which the lubricant applying roller is brought into contact with the belt and includes a high frictional portion having a coefficient of friction higher than that of the lubricant applying amount controlling layer.

7 Claims, 7 Drawing Sheets

CONVEYOR-BELT APPARATUS AND IMAGE HEATING APPARATUS

BACKGROUND OF THE INVENTION

1. Field of the Invention

The present invention relates to an image heating apparatus for heating an image formed on a sheet.

2. Description of the Related Art

Conventionally, there exists a belt fixing type fixing apparatus (image heating apparatus) which uses a fixing belt to heat and pressurize a toner image formed by an image forming apparatus such as an electrophotographic apparatus and an electrostatic recording apparatus to fix the toner image.

As the belt fixing type fixing apparatus, there is known a fixing apparatus using a fixed contact member which rubs an inner surface of a belt, such as a pressure pad for applying a pressure to the belt from its inner side and a belt guide for guiding the belt. In this fixing apparatus, a sliding frictional resistance between the inner surface of the belt and the fixed contact member increases to prevent stable running of the belt and stable conveying properties of a sheet such as paper. As a result, there is a fear that a sheet jam or an image defect due to slippage of the belt or the sheet may occur. Moreover, when the sliding frictional resistance is large, a driving torque becomes large, which causes damage to a gear (introducing drive). Therefore, reduction of the sliding frictional resistance by supplying a lubricant such as grease or oil on the inner surface of the belt has been proposed (Japanese Patent Application Laid-Open No. H10-213984). Moreover, a configuration for stably supplying a small amount of the lubricant to a lubricant applied member by providing a porous member such as polytetrafluoroethylene (PTFE) on a surface of a roller-shaped lubricant retaining member and abutting the porous member against the lubricant applied member to rotate the porous member has also been proposed (Japanese Patent Application Laid-Open No. H09-185282).

Further, a configuration of providing a lubricant applying roller as described above on the inner surface of the belt to reduce a sliding resistance between the inner surface of the belt and a fixed sliding member has been proposed (Japanese Patent Application Laid-Open No. 2007-079036).

However, the fixing apparatus using the lubricant applying roller as the lubricant applying member as described above has the following problems.

For stably applying a small amount of the lubricant onto the inner surface of the belt, the lubricant applying roller includes a lubricant retaining portion for retaining the lubricant and a lubricant applying amount regulating layer made of a porous material formed on a surface of the lubricant retaining portion. The lubricant applying amount regulating layer is generally made of a porous resin sheet material such as a non-woven fabric formed by fiber of polytetrafluoroethylene (hereinafter, referred to as PTFE), polyimide, or polyamide-imide and a resin such as polyester.

On the other hand, it is desirable that the lubricant applied member (inner surface of the belt) has a surface slidability as small as possible to reduce the sliding resistance between the lubricant applied member and the fixed member. Therefore, the sliding resistance in an abutting portion between a surface of the lubricant applying roller and the inner surface of the belt serving as the lubricant applied member becomes smaller. As a result, it becomes difficult to obtain a sufficient rotary driving force of the lubricant applying roller, which destabilizes the application of the lubricant.

It is conceivable to increase an abutment pressure of the lubricant applying roller to obtain the sufficient rotary drive of the lubricant applying roller. When the abutment pressure is increased, the rotation of the lubricant applying roller becomes stable. At the same time, however, an applying amount of the lubricant is increased. As a result, the lubricant is used up in a short period of time. Moreover, if the amount of the lubricant applied on the inner surface of the belt is large, the lubricant leaks from an end of the belt. The leaking lubricant flows to a surface of the belt to cause an image defect.

It is also conceivable to directly drive (introduce direct drive to) the lubricant applying roller. However, there is a fear that a configuration of the image heating apparatus is complicated to increase the size of the image heating apparatus itself.

SUMMARY OF THE INVENTION

In view of the above-mentioned problems, the present invention has an object of providing an image heating apparatus capable of stabilizing conveying properties of a belt by stably applying a lubricant for a long period of time without being complicated in configuration and being increased in size.

It is desirable to provide an image heating apparatus comprising: a heating rotary member for heating a toner image on a sheet at a heating nip; an endless belt for forming the heating nip between the endless belt and the heating rotary member; a pressure member provided slidably on an inner surface of the endless belt at the heating nip, for bringing the endless belt into pressure contact with the heating rotary member; and a lubricant applying member including a lubricant retaining member for retaining a lubricant and a lubricant applying amount controlling layer for controlling an applying amount of the lubricant, the lubricant applying member abutting against the inner surface of the endless belt to apply the lubricant onto the inner surface of the endless belt while rotating, wherein the lubricant applying member includes a high frictional portion, which is brought into contact with the endless belt and has a coefficient of friction higher than at least that of the lubricant applying amount controlling layer.

Further features of the present invention become apparent from the following description of exemplary embodiments with reference to the accompanying drawings.

DESCRIPTION OF THE EMBODIMENTS

First Embodiment

A first embodiment of an image heating apparatus according to the present invention will be described referring to the accompanying drawings.

(Image Forming Apparatus)

Figure 7:
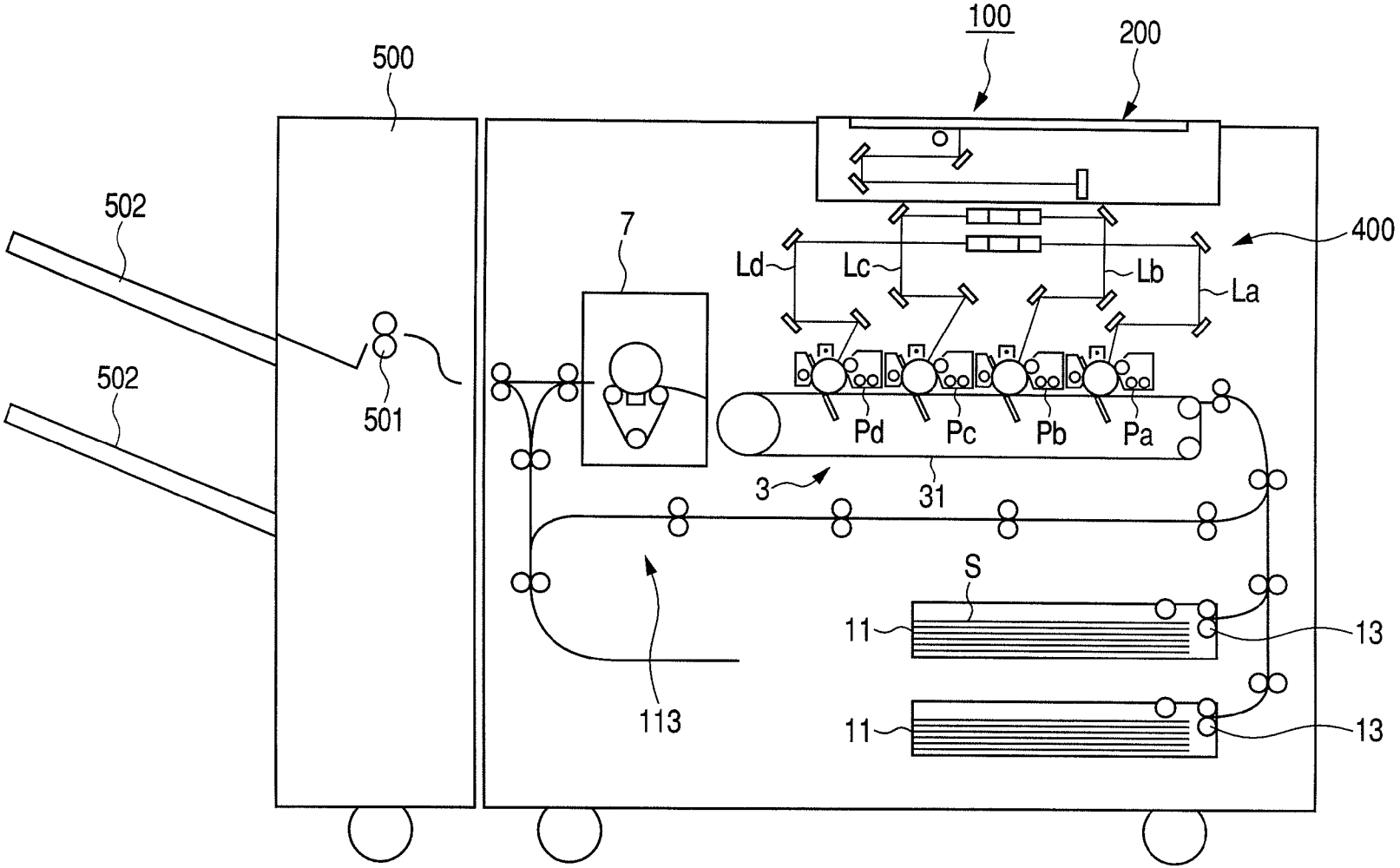
FIG. 7 is a configuration diagram of an image forming apparatus using the image heating apparatus.
Figure 8:
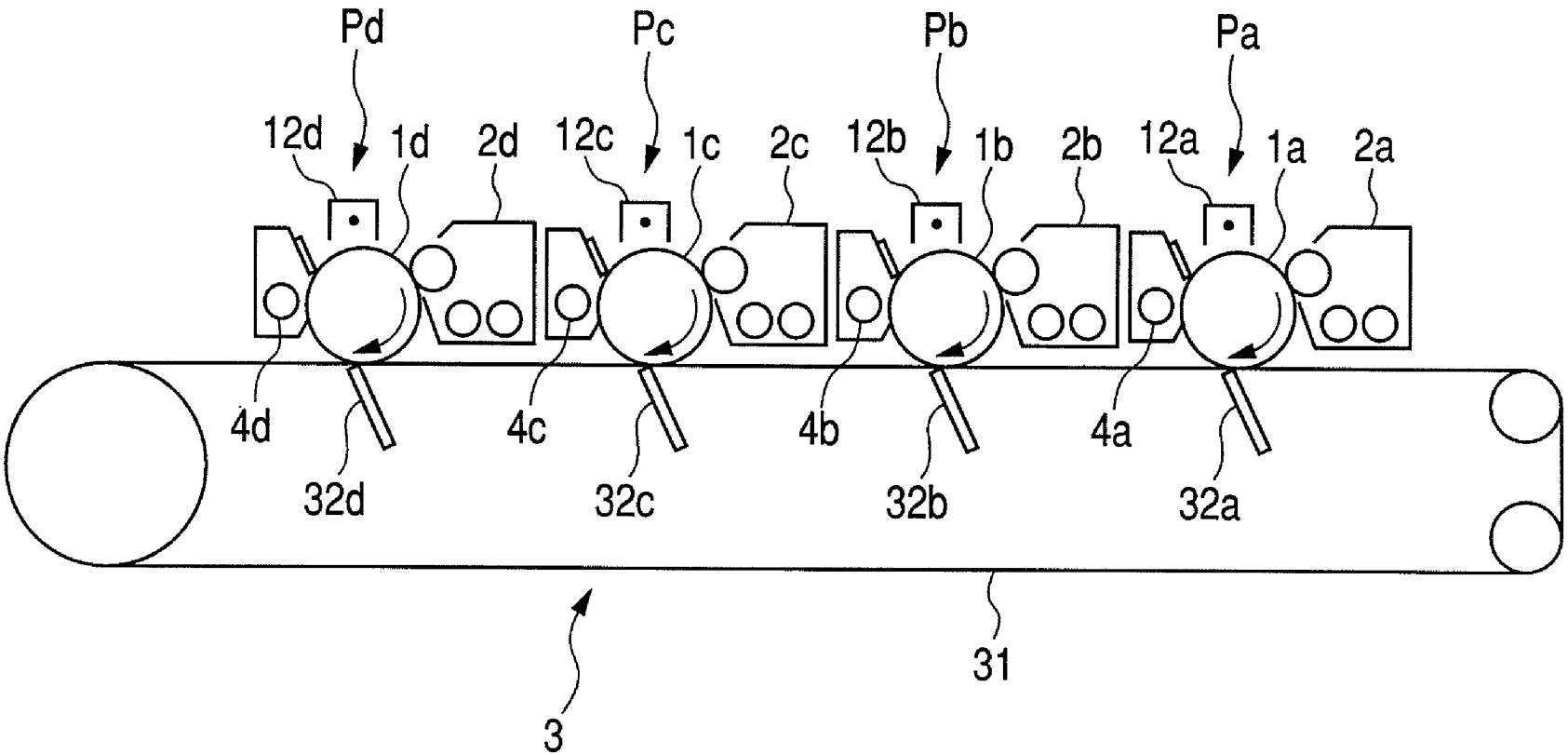
FIG. 8 is an enlarged view of an image forming station portion of the image forming apparatus.

FIG. 7 is a configuration diagram of an image forming apparatus using the image heating apparatus (fixing apparatus). FIG. 8 is an enlarged view of an image forming station portion of the image forming apparatus.

As illustrated in FIG. 7, an image forming apparatus 100 according to this first embodiment is a four-drum tandem type color printer using an electrophotographic process, which includes multiple optical scanning means.

The image forming apparatus 100 includes a reader portion 200 on its upper surface. The reader portion 200 uses a photoelectric conversion element such as a CCD to perform color separation reading processing on image information of a color original. Laser beams La, Lb, Lc, and Ld, each being modulated according to the image information obtained by the color separation reading for each color in the reader portion 200, are output from a laser scanning portion 400 including the multiple optical scanning means.

The laser beams La to Ld output from the laser scanning portion 400 are emitted to four image forming stations Pa, Pb, Pc, and Pd for respectively forming magenta, cyan, yellow, and black images.

As illustrated in FIG. 8, the laser beams La to Ld emitted to the respective image forming stations Pa to Pd expose and scan photosensitive drums 1*a*, 1*b*, 1*c*, and 1*d* charged by chargers 12*a*, 12*b*, 12*c*, and 12*d* to form electrostatic latent images on the photosensitive drums. A developer is applied to the electrostatic latent images respectively formed on the photosensitive drums la to id by developing devices 2*a*, 2*b*, 2*c*, and 2*d* to develop the electrostatic latent images as toner images.

On the other hand, each of sheets S stacked in a feed cassette 11 is conveyed to a transfer device 3 by a feed roller 13. In the transfer device 3, a transfer belt 31 conveys the sheet S to nip portions between the photosensitive drums la to id and transfer members 32*a*, 32*b*, 32*c*, and 32*d*. The toner images of the respective colors formed on the photosensitive drums 1*a* to 1*d* are sequentially transferred and superimposed to the sheet S conveyed to the nip portions.

After the transfer of the toner images, cleaners 4*a*, 4*b*, 4*c*, and 4*d* collect transfer residual toners remaining on the photosensitive drums 1*a* to 1*d*. Then, the photosensitive drums 1*a* to 1*d* are ready for next image formation.

The sheet S, on which the toner images are transferred, is separated from the transfer belt 31, and is conveyed to a fixing apparatus 7 as a belt type image heating apparatus.

The toner images transferred to the sheet S are fixed onto the sheet S by a heat and a pressure in the fixing apparatus 7. Then, the sheet S is conveyed as a full-color image formed material to a delivery processing device 500. In the delivery processing device 500, the sheet S is delivered to one of delivery trays 502 by a conveyor roller 501. The downward movement of the delivery tray 502 enables the delivery and the stacking of multiple sheets S. Processing of stapling the multiple sheets S can also be performed in the delivery processing device 500.

In a monochrome image formation mode, the image forming station Pd for forming the black image selectively performs an image formation operation. In a duplex copying mode, the one-side copied sheet S exiting from the fixing apparatus 7 is caused to alter its course toward a surface reverse re-conveying mechanism 113. The sheet S is reversed by the surface reverse re-conveying mechanism 113 to be re-fed to the transfer belt 31. As a result, the toner image is transferred to the other side of the sheet S to be formed thereon. After the sheet S is reintroduced into the fixing apparatus 7, the obtained double-sided copy is conveyed to the delivery processing device 500.

(Fixing Apparatus 7)

Figure 1:
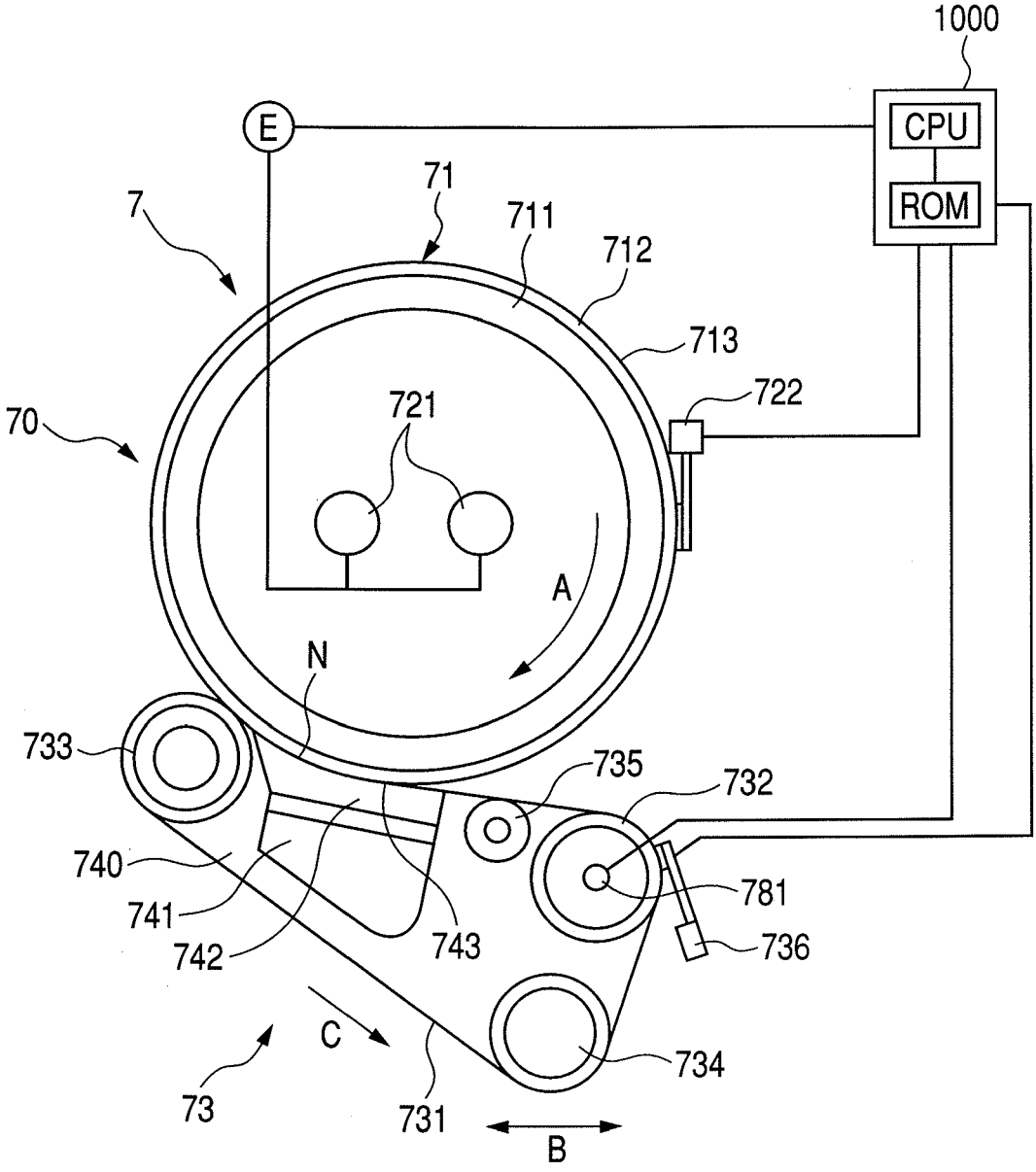
FIG. 1 is a configuration diagram illustrating an image heating apparatus according to a first embodiment of the present invention.

As illustrated in FIG. 1, the fixing apparatus 7 is a belt type image heating apparatus including a fixing roller unit 70 and a fixing belt unit 73. For the fixing apparatus 7 or the members constituting the fixing apparatus 7, longitude or a longitudinal direction indicates a direction perpendicular to a sheet conveying direction.

The fixing roller unit 70 includes a fixing roller (heating rotary member) 71. The fixing roller 71 includes a metallic core 711, an elastic layer 712, and a releasing layer 713. The elastic layer 712 is made of a silicon rubber provided on the metallic core 711 made of aluminum or the like. The releasing layer 713 is provided on the elastic layer 712 and is formed of a PFA tube for improving the toner releasability of the fixing roller 711.

The fixing roller 71 is rotated by a driving mechanism (not shown) in a direction indicated by an arrow A at a predetermined speed. In the vicinity of a center of the fixing roller 71, heaters 721 are provided. When being supplied with electric power, each of the heaters 721 generates heat to heat the fixing roller 71 from inside. A surface temperature of the fixing roller 71 is measured by a thermistor 722. A signal for the temperature detected by the thermistor 722 is input to a control circuit unit 1000. The control circuit unit 1000 controls electric power supplied from a power source E to the heaters 721 to maintain information of the detected temperature, which is input from the thermistor 722, at a predetermined fixing temperature.

The fixing belt unit 73 includes a fixing belt (endless belt) 731 serving as a circularly rotatable endless belt. The fixing belt 731 is stretched around multiple belt stretching-and-suspending members, more specifically, an entrance roller 732, a separation roller 733, and a steering roller 734. A pressure pad portion 740 serving as a pressure member is provided inside the fixing belt 731. The pressure pad portion 740 is provided slidably on an inner surface of the fixing belt 731, and presses the fixing belt 731 against the fixing roller 71 to form a fixing nip (heating nip) N. A width of the fixing nip N (length of the fixing nip N in the sheet conveying direction) is set large to sufficiently fuse the toner on the sheet S.

The fixing belt 731 includes a belt made of a heat-resistant resin such as polyimide or a metallic belt made of SUS or Ni as a base layer having a thickness of about 20 to 100 μm. The fixing belt 731 also includes an elastic layer made of a silicone rubber or the like, which has a thickness of about 20 to 500 μm, on the base layer. The fixing belt 731 includes a PFA layer having a thickness of 30 to 100 μm as a releasing layer formed on the elastic layer. An inner surface of the base layer has a surface roughness of 0.1 to 5.0 μm to keep down a sliding resistance on a contact surface with a pressure pad 742. When the metallic base layer is used, it is more desirable to coat the inner surface of the base layer with a low friction resin such as polyimide.

A belt heater 781 is provided in the vicinity of a center of the entrance roller (first belt stretching-and-suspending member) 732. When supplied with the electric power, the heater 781 generates heat to heat the entrance roller 732 from inside. The circularly rotatable fixing belt 731 is heated with the heat of the entrance roller 732. A surface temperature of the fixing belt 731 is measured by a thermistor 736 provided in the vicinity of the entrance roller 732. A signal for the temperature detected by the thermistor 736 is input to the control circuit unit 1000. The control circuit unit 1000 controls the power supply to the heater 781 to maintain information of the detected temperature, which is input from the thermistor 736, at a predetermined fixing belt temperature.

The separation roller (second belt stretching-and-suspending member) 733 made of a metal brings the fixing belt 731 into pressure contact with the fixing roller 71 by press-contacting means (not shown). The elastic layer 712 of the fixing roller 71 is deformed by the pressure-contact with the separation roller 733. The elastic layer 712 is deformed particularly at an end of its contact portion with the separation roller 733 to be curved in a direction opposite to that of the remaining part of the elastic layer 712. As a result, the toner, which is fused and pressed at the fixing nip N to adhere to a surface layer of the fixing roller 71 by a surface tension, is released from the fixing roller 71. Then, the sheet S is separated from the fixing roller 71 to be delivered.

An end portion of the steering roller 734 is movable in a direction indicated by an arrow B. The movement of the end portion of the steering roller 734 is controlled by a rocking mechanism (not shown) to correct lateral movement of the fixing belt 731 in a width direction when the fixing belt 731 rotates.

The pressure pad portion 740 includes a base 741 made of a metal such as SUS, aluminum, or iron, the pressure pad 742 made of a silicon rubber, and a sliding sheet 743 made of a PI film provided between the pressure pad 742 and the fixing belt 731.

(Oil Applying Roller 735)

Next, an oil applying roller 735 will be described.

On an inner surface of the fixing belt 731, the oil applying roller 735 serving as a lubricant applying member is provided. The oil applying roller 735 is provided between the entrance roller 732 and the pressure pad 740 and serves to apply a lubricant (oil) onto the inner surface of the fixing belt 731.

The oil applying roller 735 is rotatably supported by an arm member 737 (see FIG. 2A) which is provided to revolve about the entrance roller 732. The arm member 737 brings the oil applying roller 735 into pressure contact with the inner surface of the fixing belt 731.

Figures 2A, 2B, 2C:
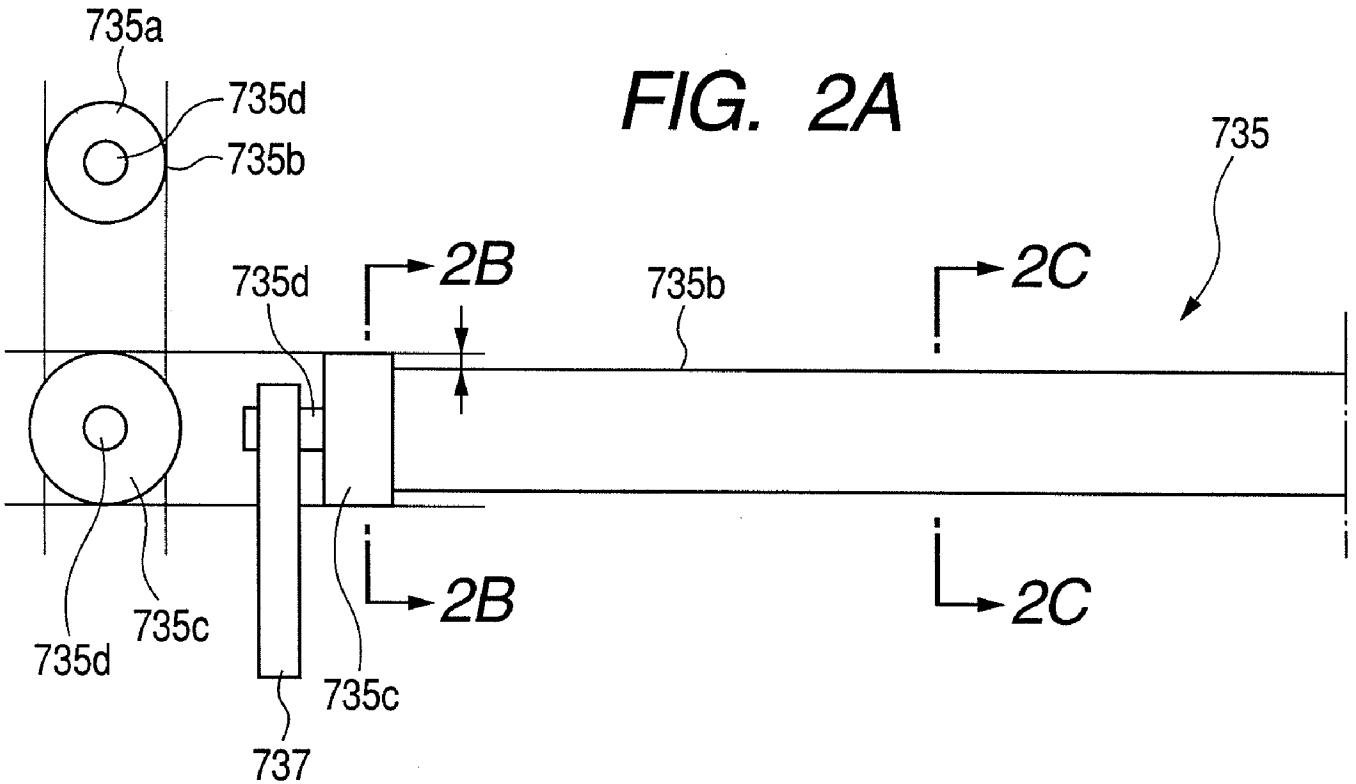
FIG. 2A is a configuration diagram of an oil applying roller.
FIG. 2B is a sectional view taken along a line 2B-2B illustrated in FIG. 2A.
FIG. 2C is a sectional view taken along a line 2C-2C illustrated in FIG. 2A.

FIG. 2C is a sectional view taken along a line 2C-2C illustrated in FIG. 2A. As illustrated in FIG. 2C, the oil applying roller 735 includes a core shaft 735*d*, an oil retaining layer (lubricant retaining layer) 735*a*, and an oil applying amount controlling layer (lubricant applying amount controlling layer) 735*b* stacked on top of one another in order of mention. As illustrated in FIG. 2A, the oil applying roller 735 has driving members (high frictional portions) 735*c* at its longitudinal end portions. An outside diameter of the driving member 735*c* is larger than that of the oil applying amount controlling layer 735*b*. The driving member 735*c* obtains a rotary driving force from the inner surface of the belt.

The oil retaining layer 735*a* is a layer which is impregnated with the most part of the oil (lubricant) to retain the impregnated oil to be applied by the oil applying roller 735. The oil impregnated in the oil retaining layer 735*a* seeps out through the oil applying amount controlling layer 735*b* to be transferred to the inner surface of the fixing belt 731 or the like.

As the lubricant, a silicone oil is suitably used in view of heat resistance. A dimethyl silicone oil, an amino-modified silicone oil, a fluorine-modified silicone oil and the like are given as examples of the silicone oil, but the silicone oil is not particularly limited thereto. Moreover, the silicone oils having various viscosities are used according to usage conditions. However, the silicone oils with an excessively high viscosity have poor fluidity for the application. Therefore, the silicone oil having a viscosity of 30,000 cSt or less is generally used. In this embodiment, the dimethyl silicone oil having a viscosity of 1,000 cSt is used.

The core shaft 735*d* is made of aluminum, iron, stainless steel, brass or the like.

The oil retaining layer 735*a* is obtained by wrapping an organic or inorganic porous material such as a sponge or a porous ceramic or an organic or inorganic woven or nonwoven fabric of fiber such as paper or cloth around the core shaft 735*d*. In particular, the nonwoven fabric made of polyester fiber is suitably used.

The oil applying amount controlling layer 735*b* is provided to allow the oil impregnated and retained in the oil retaining layer 735*a* to seep out by a proper and extremely small amount. The oil penetrates through an oil transport layer provided as needed to seep out. As the oil applying amount controlling layer 735*b*, a porous film made of a porous resin sheet material such as a nonwoven fabric made of fiber such as PTFE, polyimide or polyamide-imide and a resin such as polyester is used. In this embodiment, a PTFE porous film is used as the oil applying amount controlling layer 735*b*.

The properties of the porous film are, for example, as follows. A thickness is 15 to 130 μm. A large number of pores, each having an average pore diameter of 0.1 to 2 μm, are formed. A surface roughness Ra is 0.5 to 2.0 μm. A porosity is 60 to 90%. A porous film having an air permeance of 3 to 1,500 (sec/100 cc) in Gurley Number measured by a Gurley type densometer of type B is suitably used.

As described above, the oil applying amount controlling layer 735*b* is a porous material made of a resin. The inner surface of the fixing belt 731 is adapted to reduce the sliding resistance with the pressure pad 742. Therefore, the frictional force between the oil applying amount controlling layer 735*b* and the fixing belt 731 is reduced, resulting in difficulty in acquisition of a stable turning force.

Thus, in this embodiment, the driving members 735*c* having a coefficient of friction higher than that of the oil applying amount controlling layer 735*b* are provided on the oil applying roller 735. The driving members 735*c* come into contact with the fixing belt 731 at the longitudinal end portions of the oil applying roller 735. The driving members 735*c* obtain the driving force from the fixing belt 731 on the contact surfaces thereof to stably rotate the oil applying roller 735.

As illustrated in FIGS. 2A, 2B and 2C, the outside diameter of the driving member 735*c* is larger than that of the oil applying amount controlling layer 735*b* by several hundreds of μm. As illustrated in FIGS. 3C and 3D, each of the contact surfaces of the driving members 735*c* with the fixing belt 731 is deformed to increase a contact area when each of the driving members 735*c* abuts against the fixing belt 731. Moreover, the oil applying amount controlling layer 735*b* comes into contact with the inner surface of the fixing belt 731 with a smaller pressure. Therefore, each of the driving members 735*c* is desirably formed of a rubber member having a higher coefficient of friction, which is made of a silicon rubber or a non-fluorine rubber having a low hardness. A foamed rubber may be used to further lower the hardness.

The coefficient of friction of each of the materials is measured against a metal (stainless) under the following measurement conditions by using a friction and wear tester "FPR-2100" (manufactured by RHESCA COMPANY LIMITED).

(Measurement Conditions)

Type: ball-on-disk type
Mode: rotation mode
Ball (indenter) element: SUS 304
Pressing load: 50 gf
Turning radius: 10.0 mm
Rotation speed: 15 rpm
Measurement of the coefficient of friction: 60 seconds The driving member 735*c* has a high coefficient of friction, elasticity and heat resistance. The silicon rubber forming the driving member 735*c* has a JIS-A hardness of 10 degrees and a thermal conductivity of 0.5 W/mK. A plate sample piece (having a thickness of 2 mm) of the silicon rubber has the coefficient of friction of 1.0 to 1.1 under the above-mentioned measurement conditions.

PTFE for the oil applying amount controlling layer 735*b* has the coefficient of friction of 0.2 to 0.4 under the above-mentioned measurement conditions.

Figures 3A, 3B:
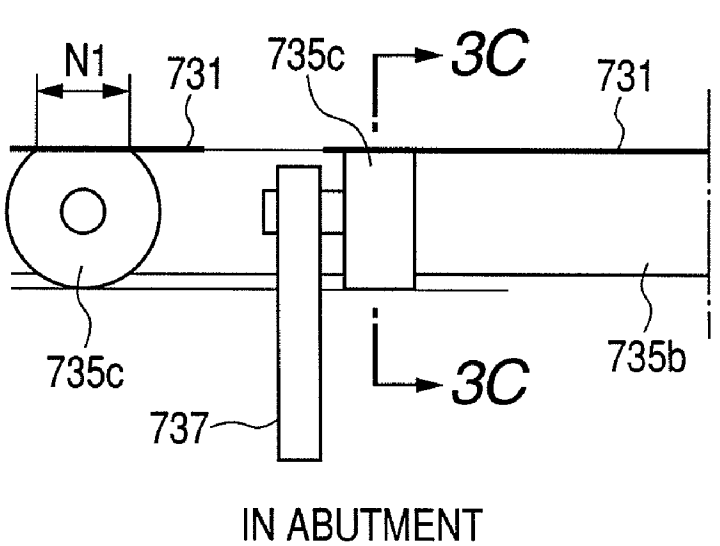
FIG. 3A is a sectional view taken along a line 3A-3A illustrated in FIG. 3B.
FIG. 3B is a view illustrating an out-of-abutment state of the oil applying roller and a fixing belt.
Figures 3C, 3D:
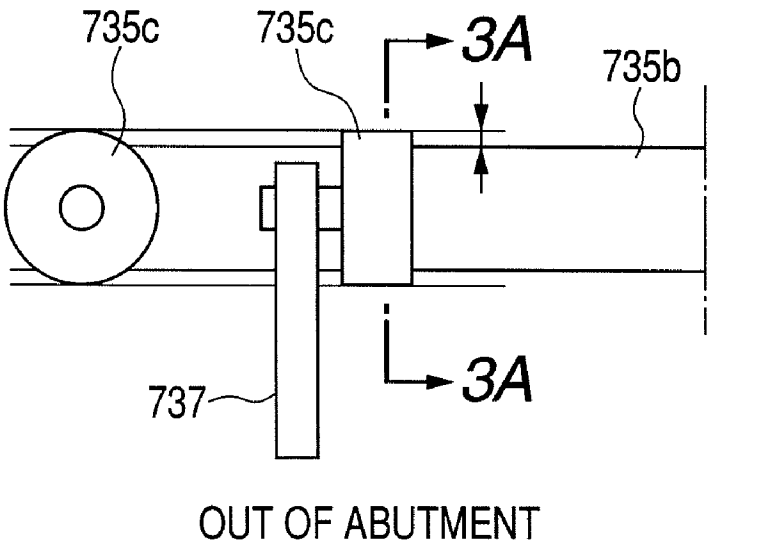
FIG. 3C is a sectional view taken along a line 3C-3C illustrated in FIG. 3D.
FIG. 3D is a view illustrating an abutment state of the oil applying roller and the fixing belt.

As illustrated in FIGS. 3A and 3B, when the driving member 735*c* and the fixing belt 731 are out of abutment, the driving member 735*c* has a larger outer shape than that of the oil applying amount controlling layer 735*b*. By selecting the material as described above, however, an abutment surface of the driving member 735*c* is deformed along the fixing belt 731 in the state where the driving members 735*c* abut against the fixing belt 731 as shown in FIGS. 3C and 3D. As a result, an abutment area (portion N1) between each of the driving members 735*c* and the fixing belt 731 can be increased. The oil applying amount controlling layer 735*b* comes into contact with the inner surface of the fixing belt 731.

Figure 4:
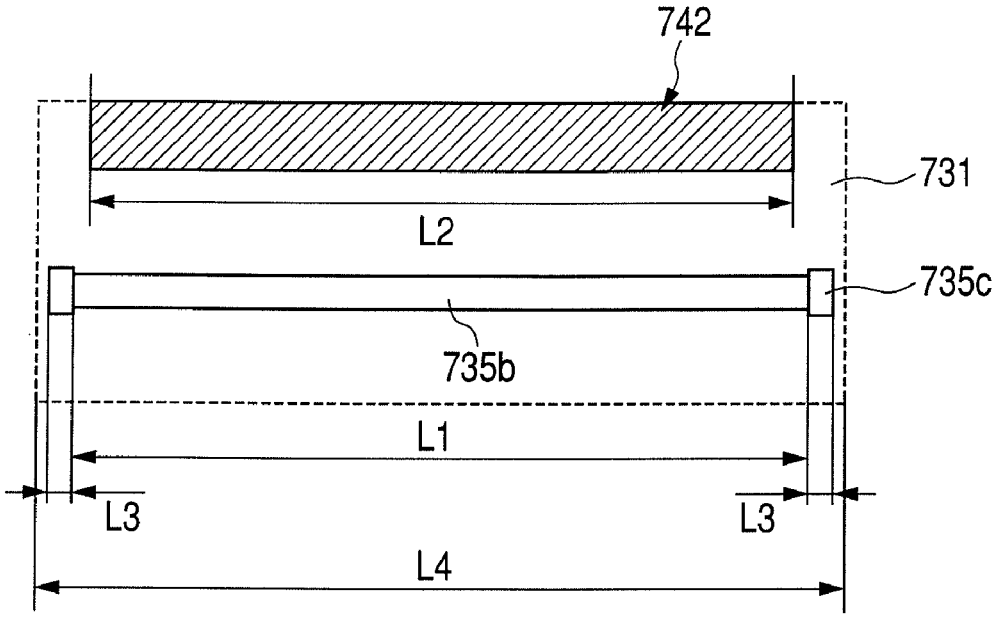
FIG. 4 is a view illustrating a longitudinal positional relation of a pressure pad, the fixing belt, and the oil applying roller.

Next, a longitudinal positional relation among the pressure pad 742, the fixing belt 731, and the oil applying roller 735 will be described. FIG. 4 is a view illustrating the longitudinal positional relation among the pressure pad 742, the fixing belt 731, and the oil applying roller 735.

A main purpose of the use of the oil is to reduce the sliding frictional resistance between the pressure pad 742 and the fixing belt 731. Therefore, a longitudinal length L1 of an oil applying surface of the oil applying roller 735 and a longitudinal length L2 of the pressure pad 742 are determined to satisfy the relation: L1>L2.

Each of the driving members 735*c* provided at the end portions of the oil applying roller 735 is necessary to come into contact with the inner surface of the fixing belt 731. Therefore, a longitudinal width L3 of each of the driving members 735*c* and a longitudinal width L4 of the fixing belt 731 are determined to satisfy the relation: L4>L1+L3×2.

The fixing belt 731 is moved in the longitudinal direction by lateral movement control or the like. Therefore, a longitudinal movement distance L5 of the fixing belt 731 is determined to satisfy the relation: L3>L5 to allow the driving members 735*c* to come into contact with the inner surface of the fixing belt 731 even when the fixing belt 731 moves.

Moreover, when there is a gap between the oil applying surface of the oil applying roller 735 and each of the driving members 735*c*, a width of the fixing belt 731 is necessary to be longer by a length of the gaps (double length of the gap).

As described above, the driving members 735*c* are provided on the oil applying roller 735. As a result, the rotation of the oil applying roller 735 can be stabilized without increasing an abutment pressure of the oil applying amount controlling layer 735*b* to the inner surface of the fixing belt 731. Therefore, the conveying properties of the fixing belt 731 and the conveying properties of the sheet such as paper can be stabilized over a long period of time. Moreover, the occurrence of a sheet jam or an image defect due to the insufficient rotation of the fixing belt 731 can be prevented. Further, the oil applying amount controlling layer 735*b* can abut against the fixing belt 731 with a small pressure to enable the application of a small amount of oil. As a result, the image defect due to the oil flowing to the surface of the belt can be prevented from occurring.

Second Embodiment

Figure 5A:
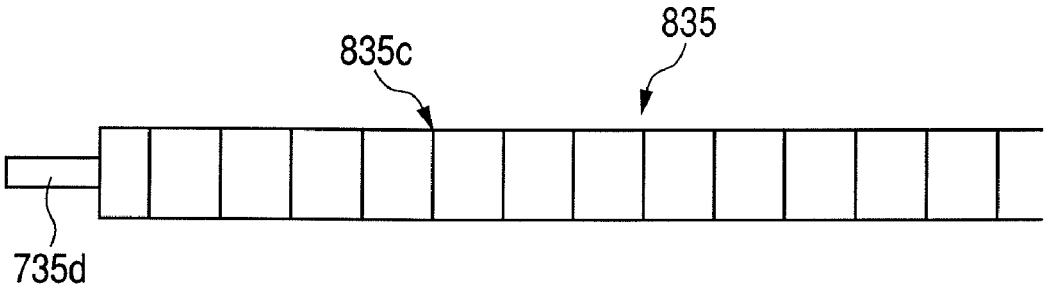
FIG. 5A is a configuration diagram of an oil applying roller according to a second embodiment of the present invention.
Figure 5B:
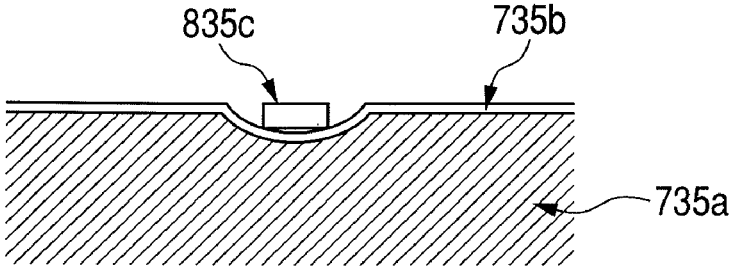
FIG. 5B is a partially enlarged view of the oil applying roller illustrated in FIG. 5A.

Next, referring to the drawings, a second embodiment of the image heating apparatus according to the present invention will be described. The same description as that of the first embodiment is herein omitted by using the same reference numerals and symbols. FIGS. 5A and 5B are configuration diagrams of an oil applying roller according to this embodiment.

The image heating apparatus according to this embodiment is provided with an oil applying roller 835 in place of the oil applying roller 735 according to the first embodiment described above. As illustrated in FIGS. 5A and 5B, the oil applying roller 835 includes driving members (high frictional portions) 835*c* in place of the driving members 735*c* of the oil applying roller 735. Similarly to the oil applying roller 735 according to the first embodiment, the oil applying roller 835 includes the oil retaining member 735*a* and the oil applying amount controlling layer 735*b*.

The driving members 835*c* are provided in a surface of the oil applying amount controlling layer 735*b* of the oil applying roller 835. The high frictional portions provided in an oil applying surface of the oil applying roller 835 in contact with the fixing belt 731 realize a simpler structure.

As illustrated in FIG. 5A, the driving members 835*c* are arranged on the oil applying amount controlling layer 735*b* in a linear manner. Each of the driving members 835*c* is an elastic member made of a silicon rubber or a fluorine rubber. Each of the driving members 835*c* is obtained by forming a high frictional material to have a ring shape with an outside diameter smaller than that of the oil applying amount controlling layer 735*b* and then fixing the ring-shaped elastic member while biting into the oil applying amount controlling layer 735*b* owing to contraction of a rubber material. In this state, the oil applying amount controlling layer 735*b* serving as the oil applying surface comes into contact with the inner surface of the fixing belt 731 when the oil applying amount controlling layer 735*b* abuts against the fixing belt 731, thereby enabling the stable application of the oil. Moreover, the driving members 835*c* can also come into contact with the inner surface of the fixing belt 731.

As a result, the rotation of the oil applying roller 835 can be stabilized. Therefore, the conveying properties of the fixing belt 731 and the conveying properties of the sheet such as paper can be stabilized for a long period of time. Moreover, the occurrence of a sheet jam or an image defect due to the insufficient rotation of the fixing belt 731 can be prevented. Further, the oil applying amount controlling layer 735*b* can abut against the fixing belt 731 with a smaller pressure to enable the application of a small amount of oil. As a result, the image defect due to the oil flowing to the surface of the belt can be prevented from occurring.

Third Embodiment

Figure 6A:
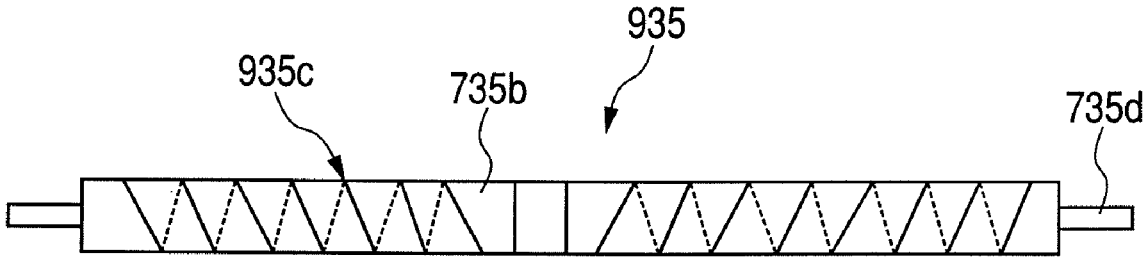
FIG. 6A is a configuration diagram of an oil applying roller according to a third embodiment of the present invention.
Figure 6B:
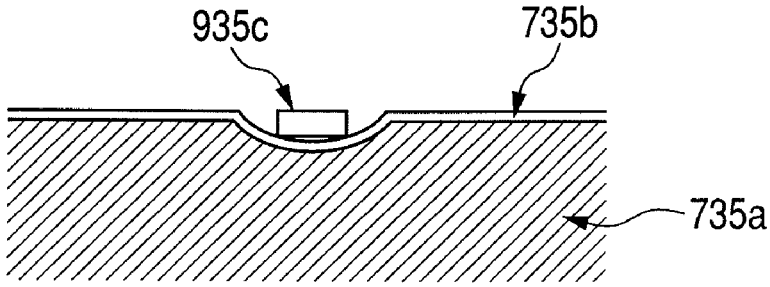
FIG. 6B is a partially enlarged view of the oil applying roller illustrated in FIG. 6A.

Next, referring to the drawings, a third embodiment of the image heating apparatus according to the present invention will be described. The same description as that of the first embodiment is herein omitted by using the same reference numerals and symbols. FIGS. 6A and 6B are configuration diagrams of an oil applying roller according to this embodiment.

The image heating apparatus according to this embodiment is provided with an oil applying roller 935 in place of the oil applying roller 835 according to the second embodiment described above. As illustrated in FIGS. 6A and 6B, the oil applying roller 935 includes driving members (high frictional portions) 935*c* in place of the driving members 835*c* of the oil applying roller 835. Similarly to the oil applying roller 735 according to the first embodiment, the oil applying roller 935 includes the oil retaining member 735*a* and the oil applying amount controlling layer 735*b*.

Each of the driving members 935*c* is formed spirally in the surface of the oil applying amount controlling layer 735*b* of the oil applying roller 935. Each of the driving members 935*c* comprises a wire member which is spirally wrapped around the oil applying amount controlling layer 735*b* from the vicinity of a longitudinal center of the oil applying roller 935 toward end portion thereof. As a result, a simple structure is realized while the effects of moving the oil toward the center of the fixing belt 731 can be obtained. Accordingly, the leakage of the oil from end portions of the fixing belt 731 can be further reduced.

Each of the driving members 935*c* is obtained by forming a high frictional elastic material such as a silicon rubber or a fluorine rubber to have a ring shape with an outside diameter smaller than that of the oil applying amount controlling layer 735*b* and fixing the ring-shaped elastic member while biting into the oil applying amount controlling layer 735*b* owing to contraction of a rubber material. In this state, the oil applying amount controlling layer 735*b* serving as the oil applying surface comes into contact with the inner surface of the fixing belt 731 when the oil applying amount controlling layer 735*b* abuts against the fixing belt 731, thereby enabling the stable application of the oil. Moreover, the driving members 935*c* can also come into contact with the inner surface of the fixing belt 731.

As a result, the rotation of the oil applying roller 935 can be stabilized. Therefore, the conveying properties of the fixing belt 731 and the conveying properties of the sheet such as paper can be stabilized for a long period of time. Moreover, the occurrence of the sheet jam or the image defect due to the insufficient rotation of the fixing belt 731 can be prevented. Further, the oil applying amount controlling layer 735*b* can abut against the fixing belt 731 with a smaller pressure to enable the application of a small amount of oil. As a result, the image defect due to the oil flowing to the surface of the fixing belt 731 can be prevented from occurring.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-036501, filed Feb. 18, 2008, which is hereby incorporated by reference herein in its entirety.

What is claimed is:

1. An image heating apparatus, comprising:

a heating rotary member for heating a toner image on a sheet at a heating nip;

an endless belt for forming the heating nip between the endless belt and the heating rotary member;

a pressure member provided slidably on an inner surface of the endless belt at the heating nip, for bringing the endless belt into pressure contact with the heating rotary member; and a lubricant applying roller including a lubricant retaining layer for retaining a lubricant and a lubricant applying amount controlling layer, which is provided at an outer surface of the lubricant retaining layer, for controlling an applying amount of the lubricant, the lubricant applying roller abutting against the inner surface of the endless belt to apply the lubricant onto the inner surface of the endless belt while rotating, wherein the lubricant applying roller includes a high frictional portion, which is brought into contact with the inner surface of the endless belt and has a coefficient of friction higher than at least that of the lubricant applying amount controlling layer.

2. An image heating apparatus according to claim 1, wherein the high frictional portion is provided at a longitudinal end portion of the lubricant applying roller.

3. An image heating apparatus according to claim 2, wherein an outside diameter of the high frictional portion is larger than an outside diameter of the lubricant applying amount controlling layer.

4. An image heating apparatus according to claim 3, wherein the outside diameter of the high frictional portion is deformed to be the same as the outside diameter of the lubricant applying amount controlling layer when the lubricant applying roller abuts against the endless belt.

5. An image heating apparatus according to claim 1, wherein the high frictional portion comprises a ring-shaped elastic member provided in a surface of the lubricant applying amount controlling layer to have an outside diameter smaller than an outside diameter of the lubricant applying amount controlling layer, and is fixed while biting into the lubricant applying amount controlling layer.

6. An image heating apparatus according to claim 1, wherein the high frictional portion is formed by wrapping a wire member around the lubricant applying amount controlling layer.

7. An image heating apparatus according to claim 6, wherein the wire member is spirally wrapped around the lubricant applying roller from a vicinity of a longitudinal center toward an end portion of the lubricant applying roller.

* * * * *